US008321969B2

(12) United States Patent
Jin

(10) Patent No.: US 8,321,969 B2
(45) Date of Patent: Dec. 4, 2012

(54) BIDET HAVING VARIABLE NOZZLE

(75) Inventor: Sung Worl Jin, Seoul (KR)

(73) Assignee: Woongjin Conway Co., Ltd., Seoul (KR)

( * ) Notice: Subject to any disclaimer, the term of this patent is extended or adjusted under 35 U.S.C. 154(b) by 611 days.

(21) Appl. No.: 12/233,343

(22) Filed: Sep. 18, 2008

(65) Prior Publication Data

US 2009/0077733 A1 Mar. 26, 2009

(30) Foreign Application Priority Data

Sep. 19, 2007 (KR) ..... 10-2007-0095119
Aug. 25, 2008 (KR) ..... 10-2008-0082752

(51) Int. Cl.
*A61H 35/00* (2006.01)
*E03D 9/08* (2006.01)

(52) U.S. Cl. ..... 4/448; 4/420.4

(58) Field of Classification Search ..... 4/443, 444, 4/445, 447, 448, 420.1, 420.2, 420.3, 420.4, 4/420.5; 239/398, 433, 434, 589, 592
See application file for complete search history.

(56) References Cited

U.S. PATENT DOCUMENTS 3,149,783 A * 9/1964 Sosnick ..... 239/11
4,550,454 A * 11/1985 Yui ..... 4/420.4
6,477,720 B2 * 11/2002 Tomita et al. ..... 4/420.4
6,754,912 B1 * 6/2004 Hayashi et al. ..... 4/420.2
6,795,981 B2 * 9/2004 Sato et al. ..... 4/420.4
7,191,473 B2 * 3/2007 Matsumoto et al. ..... 4/420.2
7,934,272 B2 * 5/2011 Zhadanov et al. ..... 4/448
8,065,755 B2 * 11/2011 Chen ..... 4/420.4
8,104,107 B2 * 1/2012 Jin ..... 4/448
2003/0140407 A1 * 7/2003 Matsumoto et al. ..... 4/420.4
2005/0022295 A1 * 2/2005 Jung ..... 4/420.4
2006/0207006 A1 * 9/2006 Koga et al. ..... 4/420.4
2008/0016609 A1 * 1/2008 Jin ..... 4/448

(Continued)

FOREIGN PATENT DOCUMENTS

JP 2004-204498 7/2004
JP 2010216239 A * 9/2010
WO WO 2006052051 A1 * 5/2006
WO WO 2010041844 A2 * 4/2010
WO WO 2010110628 A2 * 9/2010

OTHER PUBLICATIONS

Chinese Office Action dated Mar. 23, 2010 for corresponding Chinese patent application No. 200810149176.8 (w/English translation).

*Primary Examiner* — Basil Katcheves
*Assistant Examiner* — Rodney Mintz
(74) *Attorney, Agent, or Firm* — Ohlandt, Greeley, Ruggiero & Perle, LLP

(57) ABSTRACT

A bidet having a variable nozzle. The bidet includes a linear channel connected to a feed channel through which water is fed, a nozzle part connected to the linear channel and ejecting the water toward an area of the human body to be washed, and a variable channel connected to opposite sides of the nozzle part and feeding the water to the nozzle part while the water to be ejected is pressurized symmetrically on the opposite sides of the nozzle part. Thereby, the bidet can adjust a spreading angle of the water ejected from the nozzle part according to an area to be washed.

7 Claims, 11 Drawing Sheets

U.S. PATENT DOCUMENTS

2008/0047055 A1* 2/2008 Lim ..... 4/447
2011/0041243 A1* 2/2011 Kwon ..... 4/443
2011/0072570 A1* 3/2011 Morotomi et al. ..... 4/420.2
2011/0203043 A1* 8/2011 Jin et al. ..... 4/443
2011/0203044 A1* 8/2011 Lim ..... 4/447
2012/0005817 A1* 1/2012 Jeong et al. ..... 4/420.4

* cited by examiner

BIDET HAVING VARIABLE NOZZLE

BACKGROUND OF THE INVENTION

1. Field of the Invention

The present invention relates, in general, to a bidet having a variable nozzle and, more particularly, to a bidet having a variable nozzle, in which an angle in which water ejected from the nozzle is spread can be adjusted.

2. Description of the Related Art

Generally, bidets refer to fixtures that are mounted on a toilet and enable a user to wash the genitalia, the anus, etc. using water ejected after defecating. Bidets are more sanitary than toilet paper, and have an additional variety of functions. As such, bidets have had a sharp increase in demand.

Bidets are generally mounted on a flush toilet which includes a cistern and a toilet stool. Each bidet includes a body in which various electronics and machines for driving the bidet are installed, and a nozzle ejecting water for washing, and so on.

Further, a seat and a lid included in the ordinary flush toilet can be also interpreted as constituent parts of the bidet. This is because the seat can have a built-in thermostatic device, and because the lid can be realized so as to be automatically opened/closed.

Meanwhile, the nozzle for the bidet is used as a passage through which water for washing and cleaning is fed. An ejecting direction of the water is determined by a preset water pressure. Further, the water pressure and an ejecting position of the nozzle are selected according to the areas to be washed or cleaned.

However, the water pressure of the bidet nozzle is not always kept constant, and thus can be varied due to various factors. In this case, the ejecting position or area of the nozzle can be varied.

A bidet is an apparatus that can adjust the ejecting position or area of the bidet nozzle by adjusting the water pressure temporarily or as needed. To this end, the bidet is provided with various nozzle tips, or makes use of sliding of the bidet nozzle.

The generalized nozzle installed on the bidet includes a nozzle that ejects a jet of water, which is spread in circular symmetry because of the water pressure applied to the nozzle on the side of the center of a discharge port, toward the anus and the external vulva.

However, the conventional nozzle installed on the bidet causes unnecessary waste of the water jet because the water jet spread in a circular shape arrives at an area wider than the area to be washed, and has a long dry time after washing due to the washing of the wide area.

SUMMARY OF THE INVENTION

Accordingly, the present invention has been made keeping in mind the above problems occurring in the related art, and embodiments of the present invention provide a bidet having a variable nozzle, capable of changing the shape of a flow of water discharged from a nozzle part such that a range of washing water ejected from the nozzle can properly reach an area to be washed, and drying time can be reduced by decreasing the area to be dried after washing.

In embodiments of the present invention, there is provided a bidet having a variable nozzle, which includes: a linear channel connected to a feed channel through which water is fed; a nozzle part connected to the linear channel and ejecting the water towards an area of the human body to be washed; and a variable channel connected to opposite sides of the nozzle part and feeding the water to the nozzle part while the water to be ejected is pressurized symmetrically on opposite sides of the nozzle part.

The nozzle part may include: a circular channel ejecting the water and connected with the variable channel; and an expansion opening formed on diametrically opposite sides of the circular channel at a width less than a diameter of the circular channel, spreading an ejection hole formed at an upper end of the circular channel, and formed so as to intersect with a flow direction of the water introduced from the variable channel.

The expansion opening of the nozzle part may have an arcuate shape centering the circular channel.

Further, the expansion opening may include vertical cutting faces at an upper inner portion thereof, each of which is formed upwards and is spaced apart from the center of the circular channel by a predetermined distance.

The variable channel may include: branch channels connected to the feed channel for feeding the water, dividing and feeding the water to opposite lower sides of the nozzle part, and symmetrically pressurizing the water flowing through the nozzle part on the opposite lower sides of the nozzle part; pressurizing channels connected to ends of the branch channels in a downward direction; and gradually narrowing channels.

Each of the pressurizing channels may have an inclined face at an end thereof which is inclined in a flow direction of the water flowing through the nozzle part.

The linear channel and the variable channel may be connected to a main channel and a sub-channel through which the water is fed respectively. The nozzle part may discharge a linear water flow when the main channel is open while the sub-channel is closed and an arcuate water flow when the main channel and the sub-channel are open.

The arcuate water flow, which is discharged from the nozzle part when the main channel and the sub-channel are open, may be varied in a spreading angle depending on a mixing ratio of an amount of the water flowing through the linear channel to that of the water flowing through the variable channel.

According to the embodiments of the present invention, the bidet having a variable nozzle pressurizes the washing water on the opposite sides of the nozzle part immediately prior to ejection by means of jets of inflow water, and thus ejects the washing water in an arcuate shape, so that an ejected range of washing water ejected from the nozzle can properly reach a washing area, and so that drying time can be reduced by decreasing the range to be dried following washing.

Additional advantages, objects, and features of the invention will be set forth in part in the description which follows and in part will become apparent to those having ordinary skill in the art upon examination of the following or may be learned through practice with the invention. The objectives and other advantages of the invention may be realized and attained by the structure particularly pointed out in the written description and claims hereof as well as by reference to the appended drawings.

BRIEF DESCRIPTION OF THE DRAWINGS

The above and other objects, features and other advantages of the present invention will be more clearly understood from the following detailed description to be taken in conjunction with the accompanying drawings, in which.

DETAILED DESCRIPTION OF THE INVENTION

Reference will now be made in greater detail to exemplary embodiments of the invention with reference to the accompanying drawings. Thus, a bidet having a variable nozzle according to exemplary embodiments of the present invention will be described below in detail with reference to the accompanying drawings.

Figure 1A:
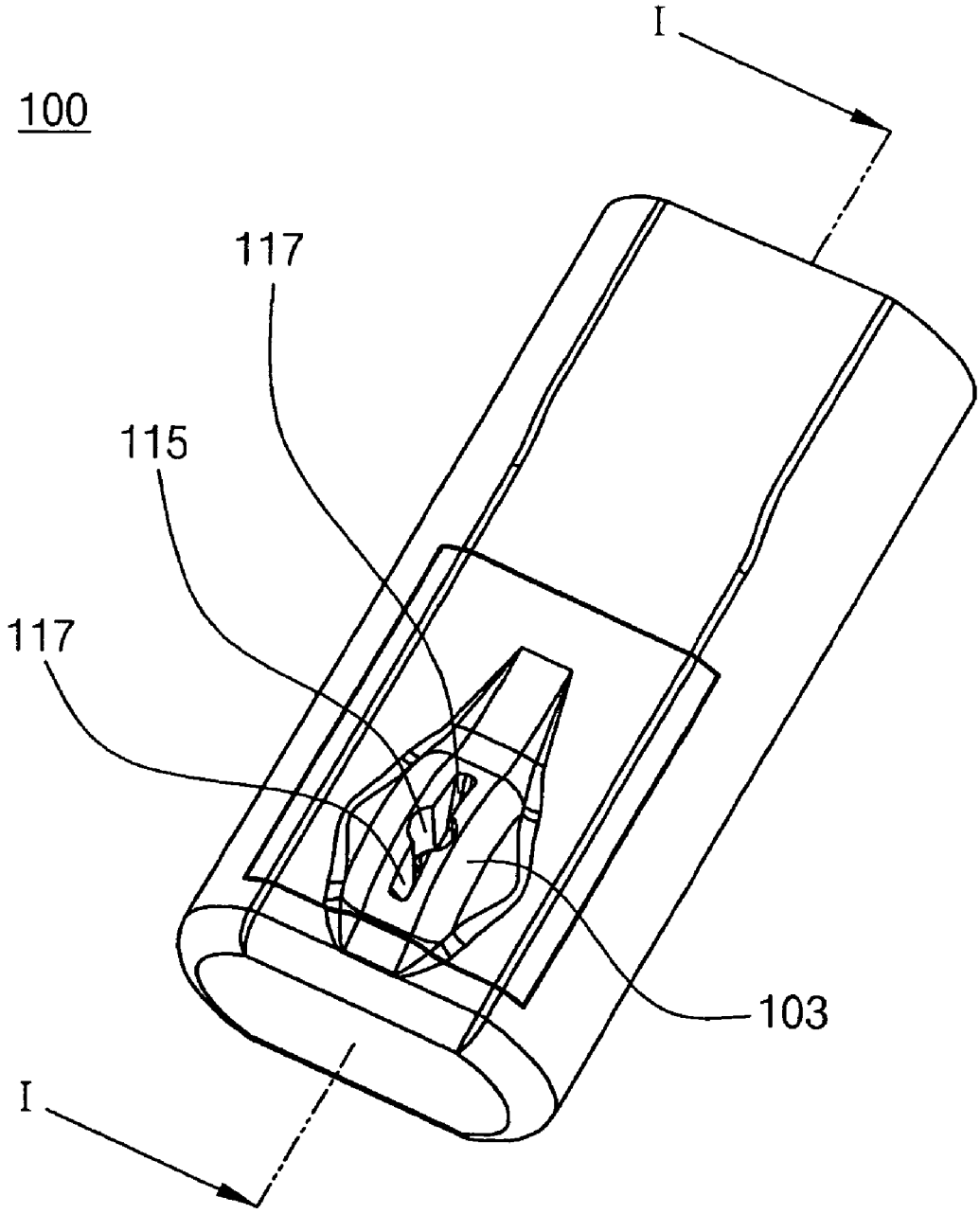
FIGS. 1A, 1B and 1C are perspective views illustrating a bidet having a variable nozzle according to an embodiment of the present invention.
Figure 1B:
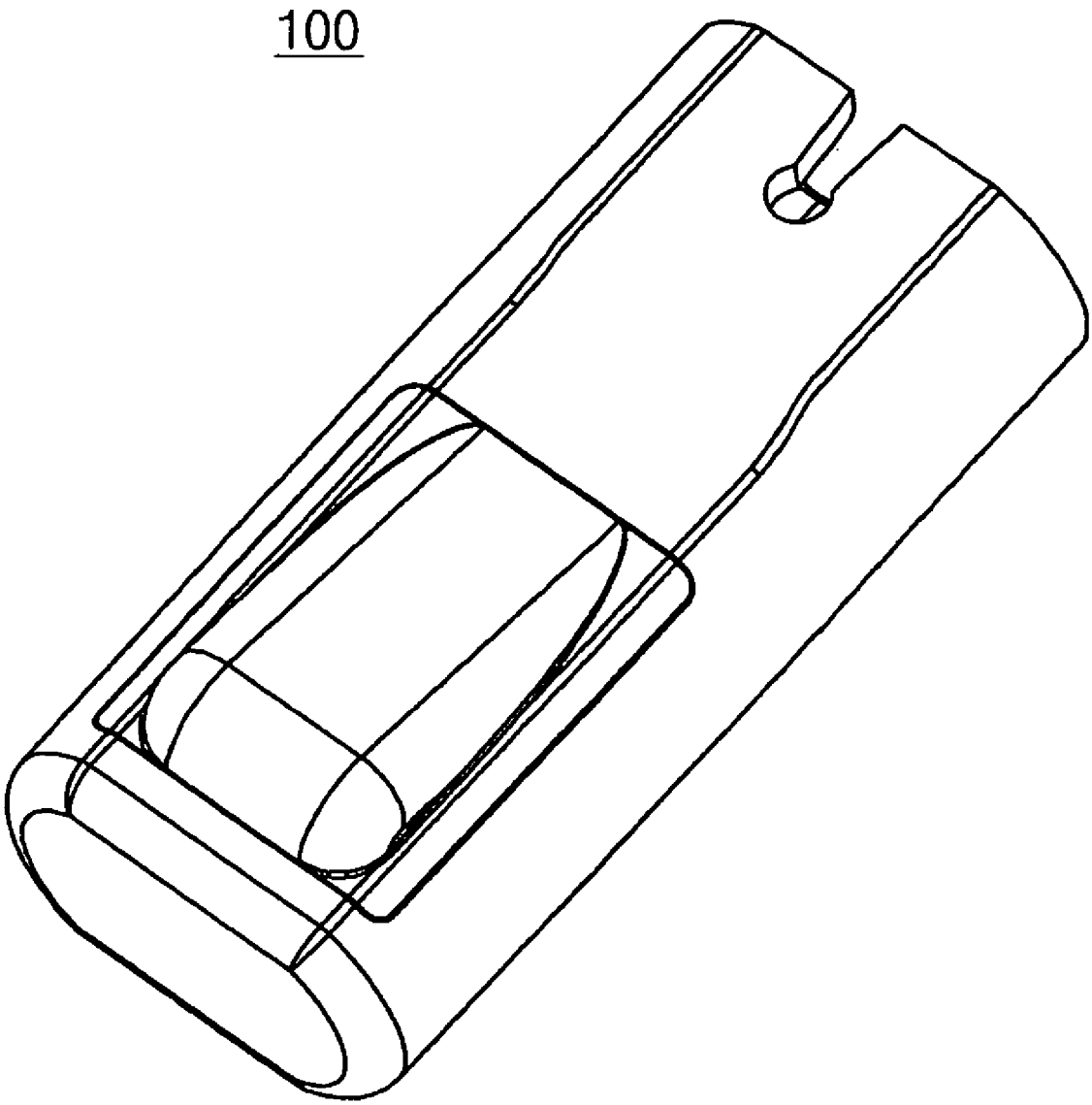
Figure 1C:
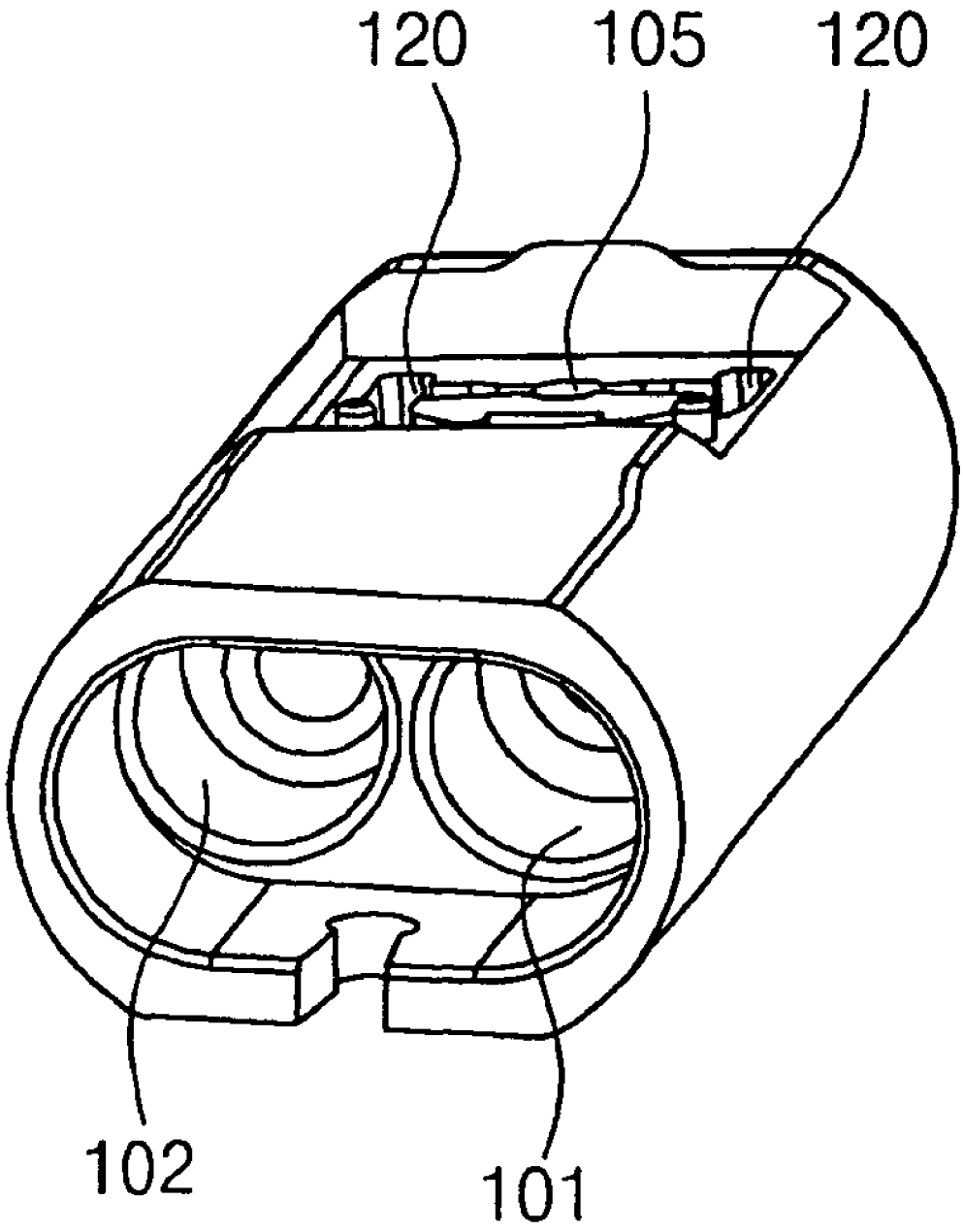
Figure 2:
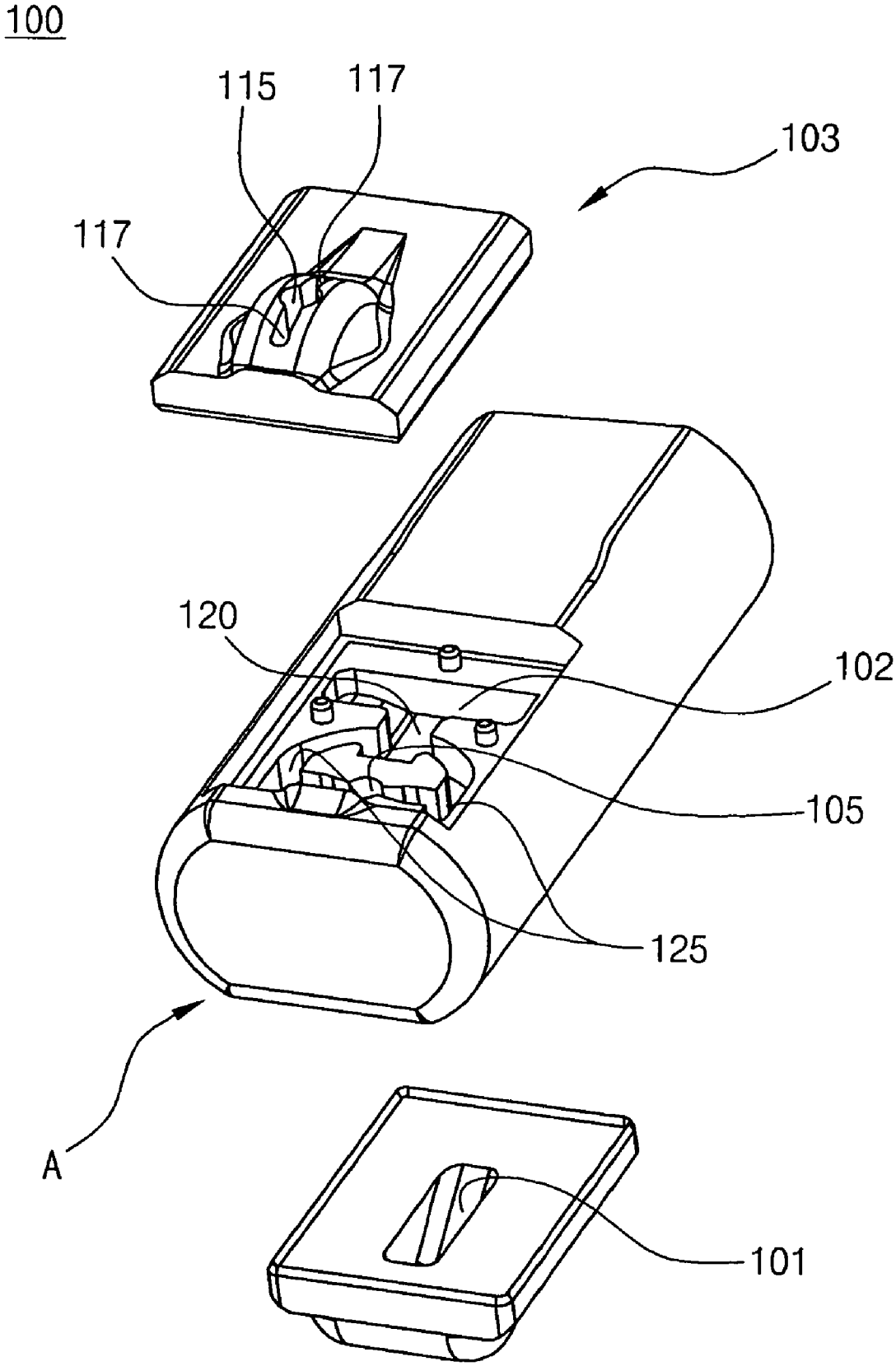
FIG. 2 is an exploded view illustrating the bidet of FIG. 1A.
Figure 3:
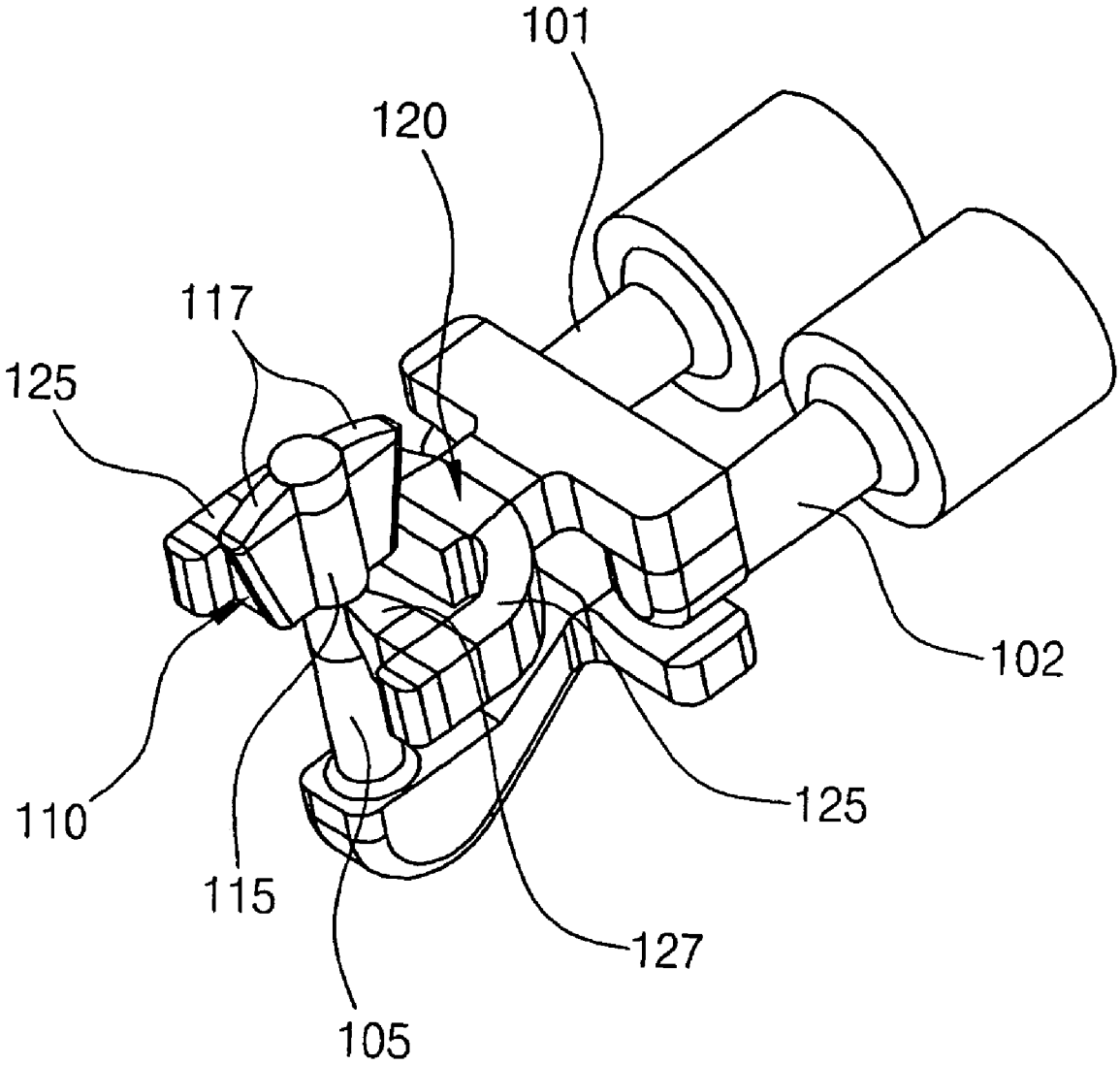
FIG. 3 is a perspective view illustrating the shapes of channels formed in the bidet of FIG. 1A.
Figure 4:
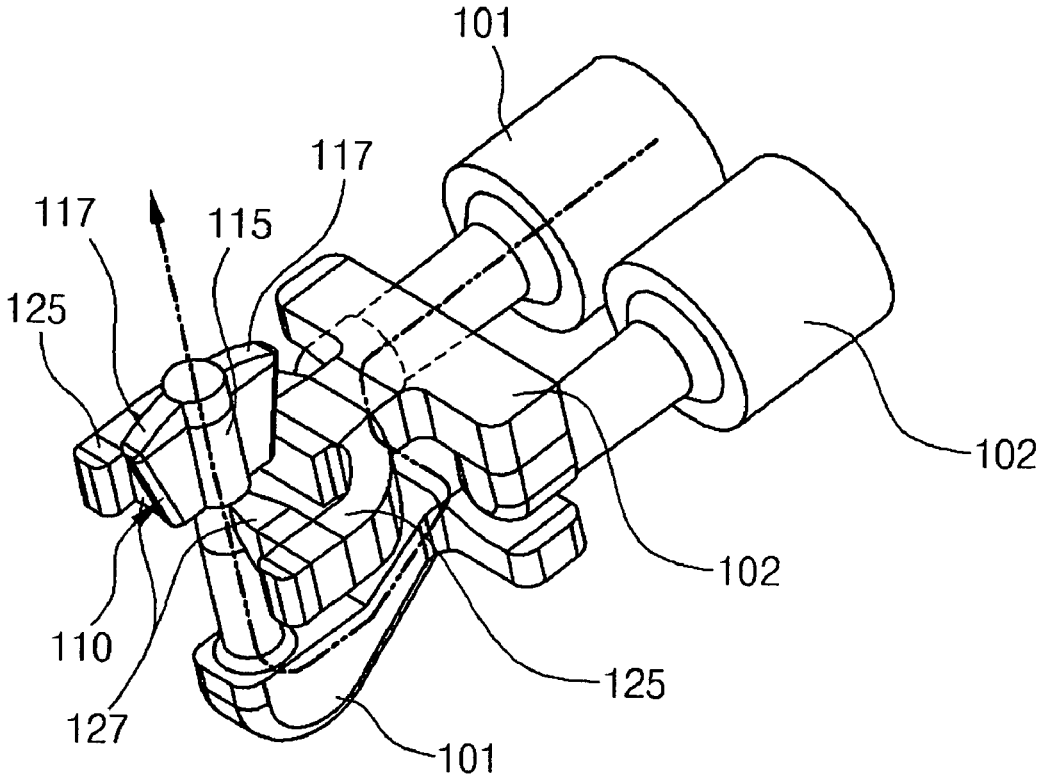
FIG. 4 illustrates operation of the channels of FIG. 3.
Figure 4:
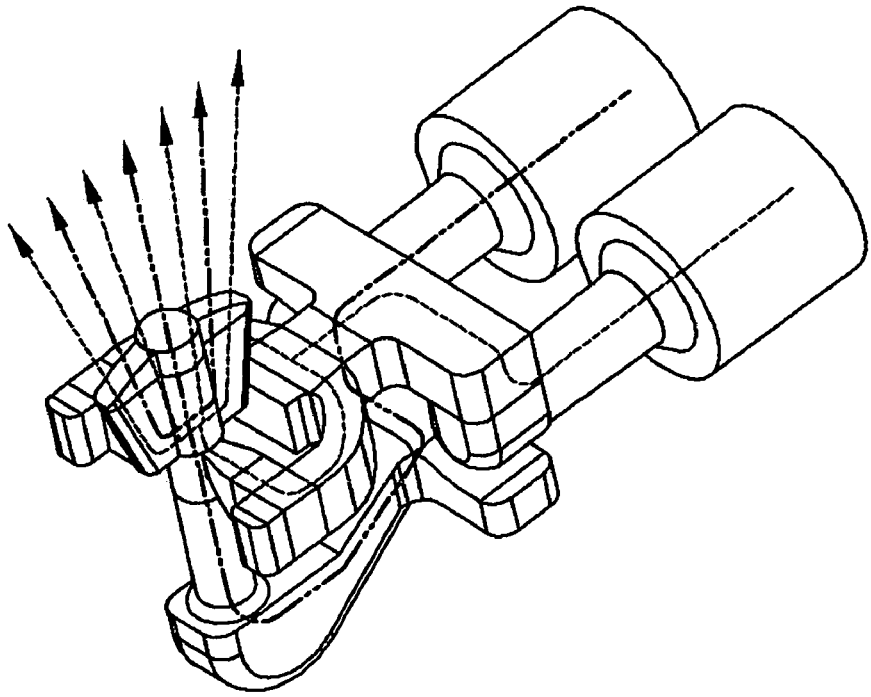
Figure 5:
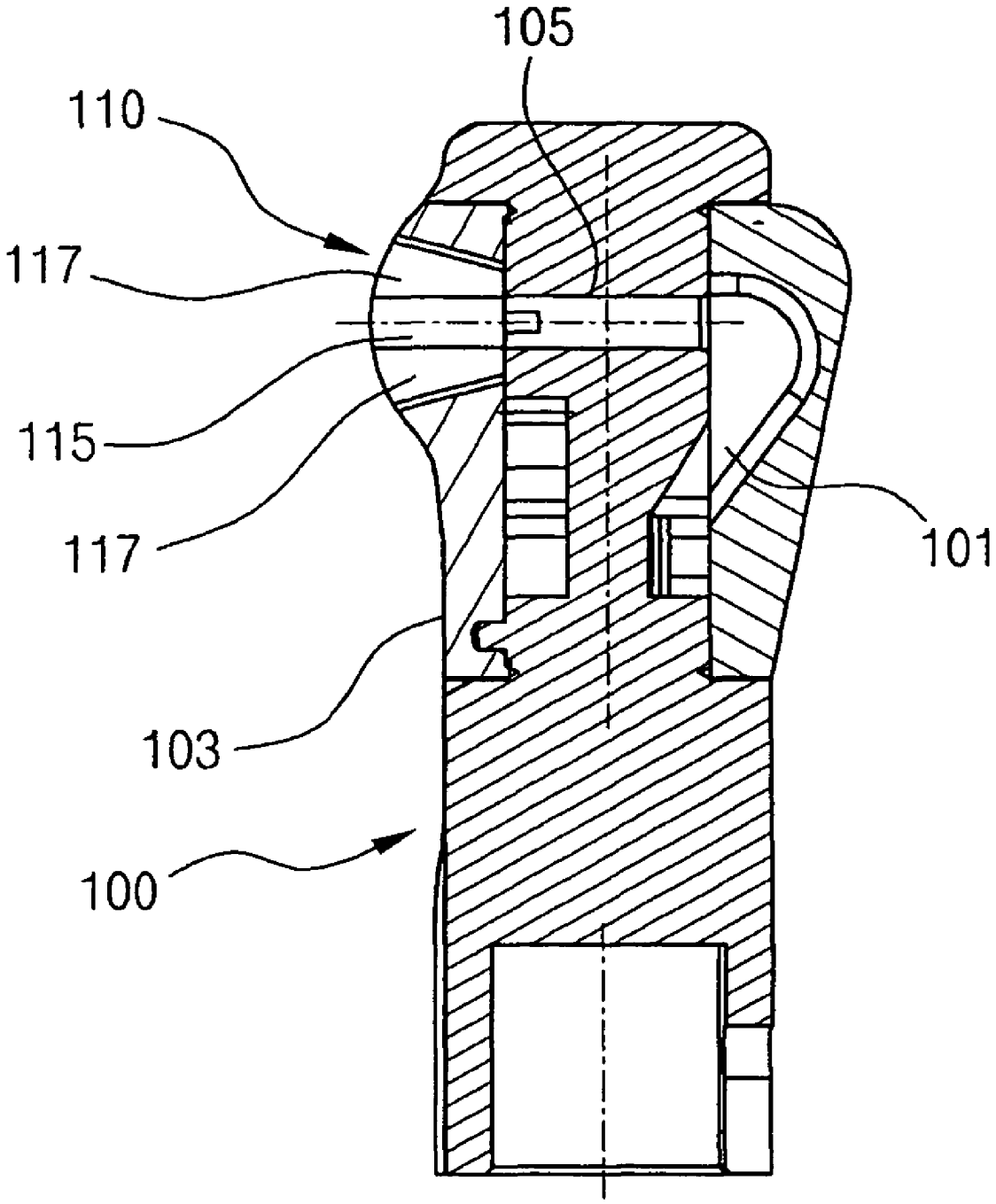
FIG. 5 is a cross-sectional view taken along line I-I of FIG. 1A.
Figure 6:
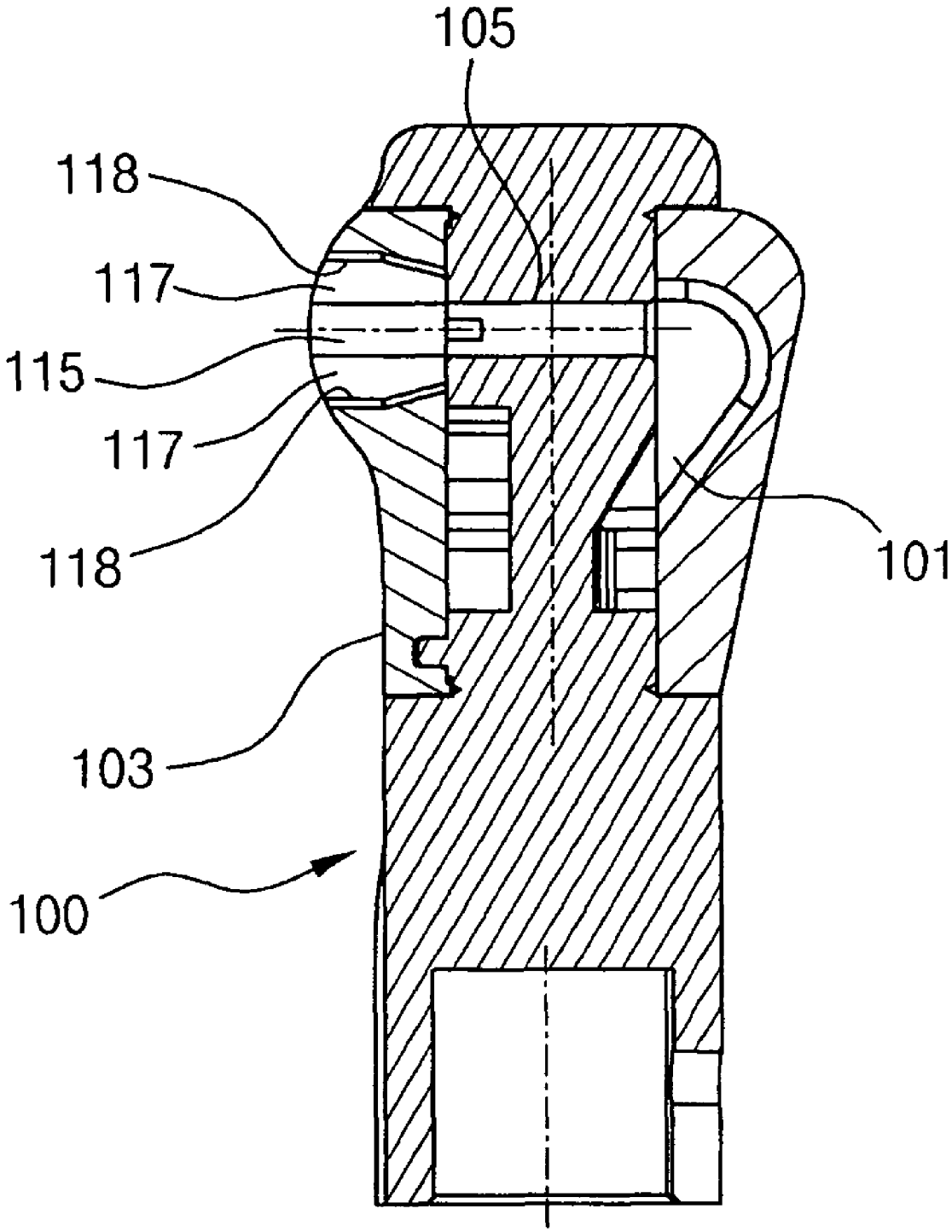
FIG. 6 is a cross-sectional view illustrating a bidet having a variable nozzle according to another embodiment of the present invention.
Figure 7:
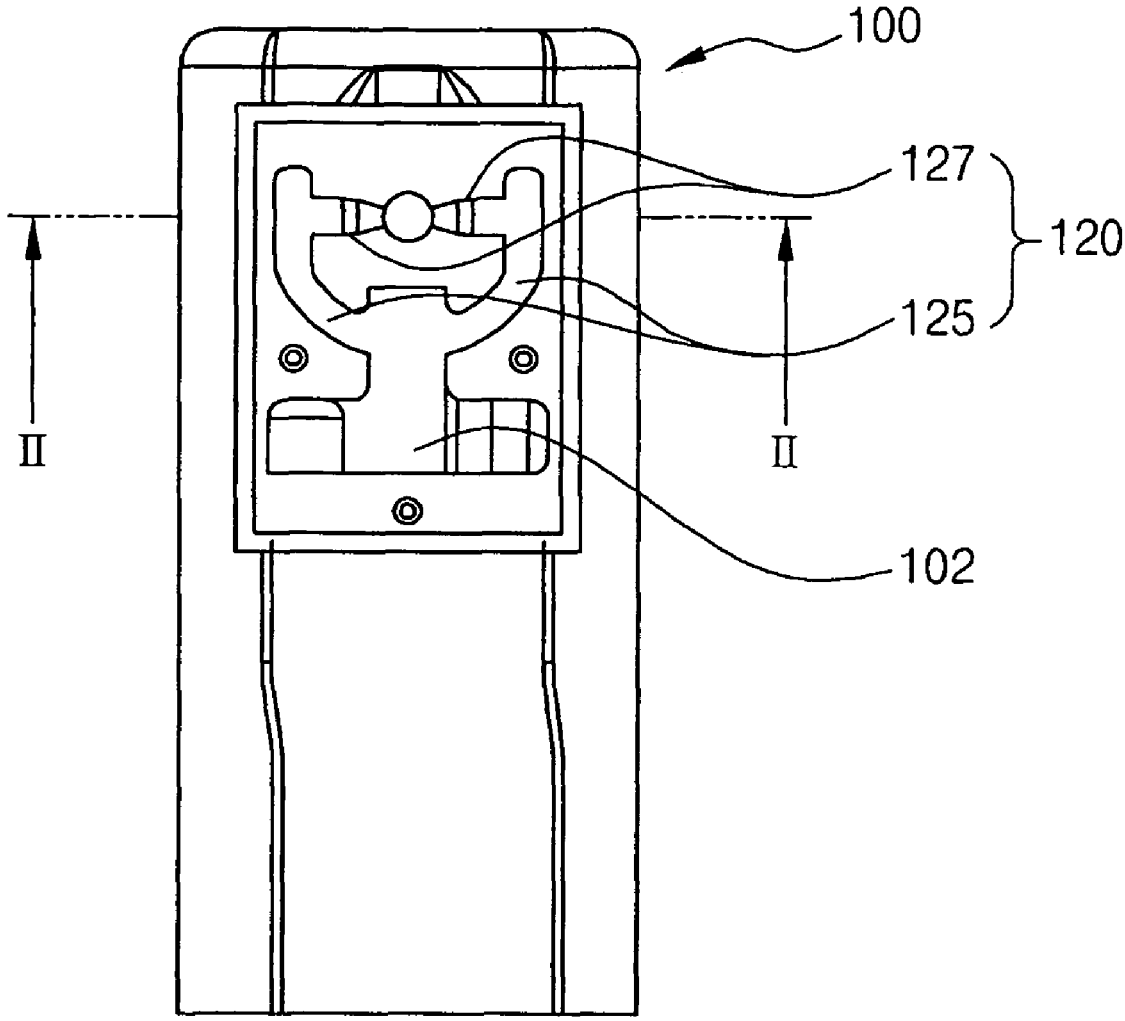
FIG. 7 is a top plan view illustrating part A of FIG. 2.
Figure 8:
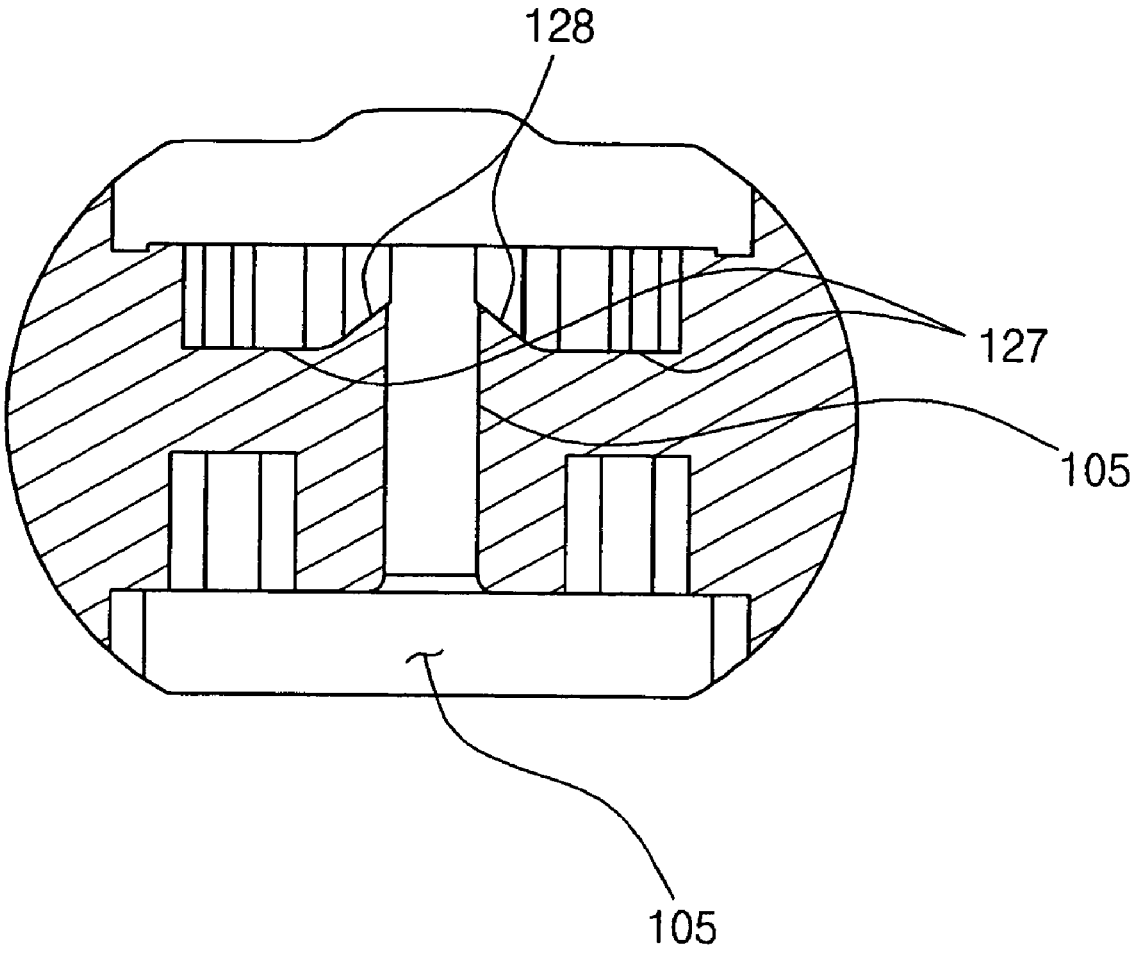
FIG. 8 is a cross-sectional view taken along line II-II of FIG. 7.
Figure 9:
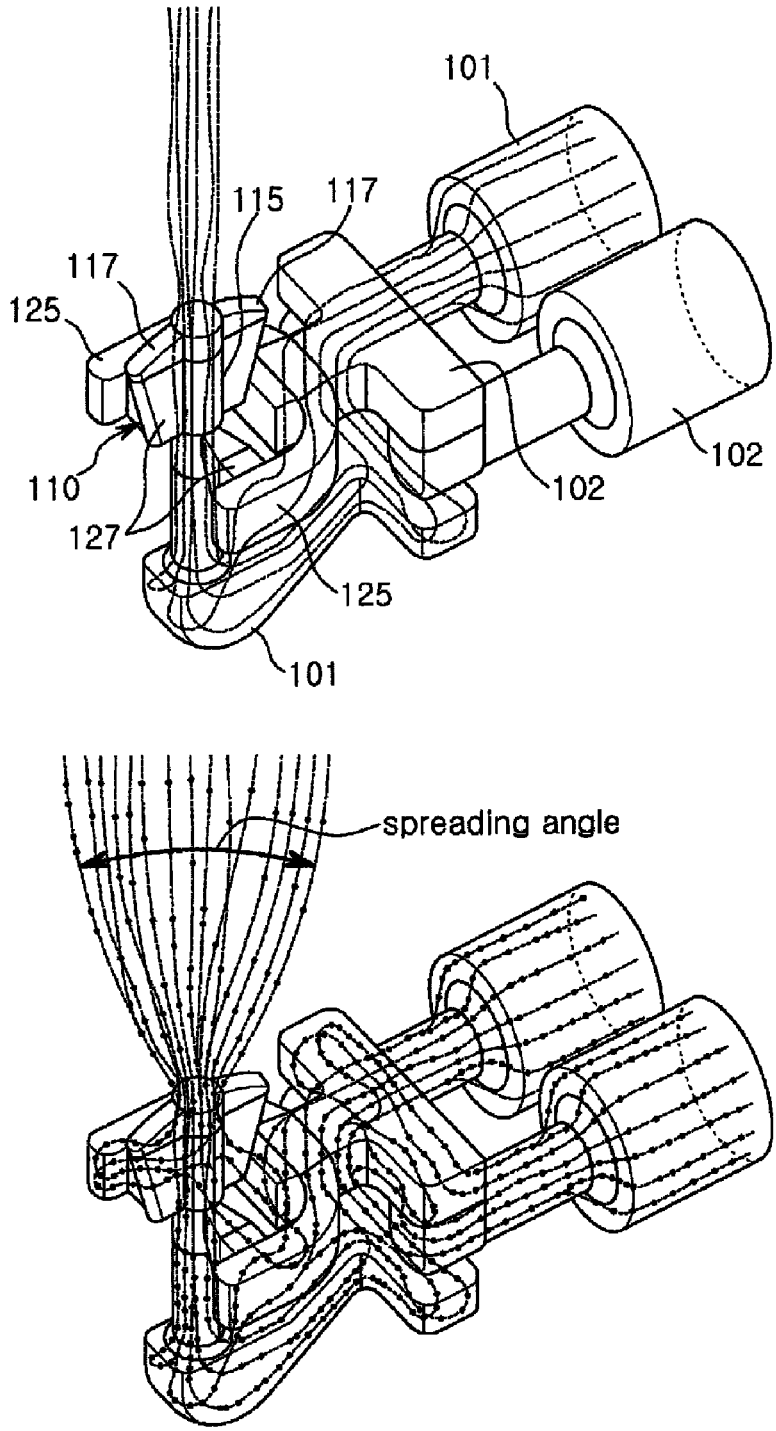
FIG. 9 further illustrates the operation of the channels depicted in FIGS. 3 and 4.

FIGS. 1A, 1B and 1C are perspective views illustrating a bidet having a variable nozzle according to an embodiment of the present invention. FIG. 2 is an exploded view illustrating the bidet of FIG. 1A. FIG. 3 is a perspective view illustrating the shapes of channels formed in the bidet of FIG. 1A. FIG. 4 illustrates operation of the channel of FIG. 3. FIG. 5 is a cross-sectional view taken along line I-I of FIG. 1A. FIG. 6 is a cross-sectional view illustrating a bidet having a variable nozzle according to another embodiment of the present invention. FIG. 7 is a top plan view illustrating part A of FIG. 2. FIG. 8 is a cross-sectional view taken along line II-II of FIG. 7.

As illustrated in FIGS. 1A through 5, the bidet having a variable nozzle according to an embodiment of the present invention includes a linear channel 105, which is formed in a nozzle body 100 and is connected to a feed channel through which water is fed, a nozzle part 110, which is connected to the linear channel 105 and ejects the water towards the area of a human body to be washed, and a variable channel 120, which is connected to opposite sides of the nozzle part 110 and feeds the water to the nozzle part 110 while the water to be ejected toward to the nozzle part 110 is pressurized symmetrically on the opposite sides of the nozzle part 110.

Further, the linear channel 105 is vertically mounted in the front of the nozzle body 100 in which the feed of the water is controlled in the bidet installed on a toilet, and is connected to a main channel 101, which is installed in the nozzle body 100 and feeds the water from the front to the rear of the nozzle body 100.

Further, the variable channel 120 is connected to a sub-channel 102, which is installed in the nozzle body in parallel to the main channel 101. When a narrow and long area to be washed is to be formed, the sub-channel 102 is fed with the water. In this case, the variable channel 120 pressurizes the water to be ejected through the nozzle part 110 such that the water has a narrow spreading angle and a long ejecting distance.

At this time, the linear channel 105 and the variable channel 120 are flow passages formed in the front of the interior of the nozzle body 100, whereas the main channel 101 and the sub-channel 102 are flow passages formed in the rear of the interior of the nozzle body 100. The nozzle body 100 is mainly formed by plastic molding, and is made up of a combination of various flow passages. Thus, the linear channel 105, the variable channel 120, the main channel 101, and the sub-channel 102 can be easily formed in the nozzle body 100.

Here, the nozzle part 110 is an ejection passage formed in the nozzle tip 103 coupled to the front upper portion of the nozzle body 100, and includes a circular channel 115, which ejects water and is connected on opposite sides of the variable channel 120, and an expansion opening 117, which is formed on diametrically opposite sides of the circular channel 115 at a width less than a diameter of the circular channel 115, spreads an ejection hole formed at an upper end of the circular channel 115 so as to spread the water jet, and is formed so as to intersect with a flow direction of the water introduced from the variable channel 120.

Here, when the water is fed only through the linear channel 105 by opening the main channel 101 and by closing the sub-channel 102, the water is ejected through the circular channel 115 vertically connected to the linear channel 105, and a cylindrical flow of water is discharged from the nozzle part 110.

Unlike in the above operation, when the water is fed through both the linear channel 105 and the variable channel 120 by the opening of both the main channel 101 and the sub-channel 102, the water fed through the variable channel 120 pressurizes the jet of water, which is to be ejected through the circular channel 115, on the opposite lower sides of the circular channel 115 immediately prior to the ejection, and thus an arcuate flow of water is discharged from the nozzle part 110. In this case, the spreading angle of the water is varied depending on a mixing ratio of an amount of the water flowing through the linear channel 105 to that of the water flowing through the variable channel 120, and thus the shape of the discharged water flow may be varied.

In detail, when the water jet pressurized in a central direction by the water of the variable channel 120 below the circular channel 115 reaches the expansion opening 117, the water jet is spread toward the expansion opening 117 extending to the diametrically opposite sides of the circular channel 115. In this case, the water jet is ejected through the circular channel 115 and the expansion opening 117, so that it can be ejected upwards at a spreading angle less than 90°. Of course, the spreading angle greater than 90° can be formed according to the size of the expansion opening 117 and the amount of water flowing through the variable channel 120.

Here, the expansion opening 117 of the nozzle part 110 is formed in an arcuate shape by extending with a predetermined width to the diametrically opposite sides of the circular channel 115. Thus, the water pressurized below the circular channel 115 reaches the upper end of the circular channel 115, and then is ejected upwards while spreading to the opposite sides of the circular channel 115. At this time, the water can be ejected in the arcuate shape.

Here, the top of the expansion opening 117 is gradually inclined from the center to the opposite sides of the circular channel 115, so that the water jet passing through the top of the expansion opening 117 can be easily spread in the arcuate shape.

Referring to FIG. 4, when the water is fed only to the main channel 101, the linear water flow is discharged from the nozzle part 110. When the water is fed to the main channel 101 and the sub-channel 102, the arcuate water flow is discharged from the nozzle part 110. At this time, the spreading angle of the water can be made as dependent on an amount of the water fed through the sub-channel 102.

Further, as illustrated in FIG. 6, an upper inner portion of the expansion opening 117 includes vertical cutting faces 118, each of which is formed upwards and is spaced apart from the center of the circular channel 115 by a predetermined distance. Thus, the water jet spread by the expansion opening 117 can be ejected after flowing along the vertical cutting faces 118. The vertical cutting faces 118 prevent the water jet ejected from the expansion opening 117 from being excessively widely spread, so that the water jet can be provided without being spread to an area wider than the area to be washed although the expansion opening 117 be only slightly distant from the washing area.

As illustrated in FIGS. 7 and 8, branch channels 125 are included in the variable channel 120, and they are connected to the feed channel for feeding the water, divide and feed the water to the opposite lower sides of the nozzle part 110, and symmetrically pressurize the water flowing through the nozzle part 110 on the opposite lower sides of the nozzle part 110. The variable channel 120 also includes pressurizing channels 127, which are connected to ends of the branch channels 125 and are provided in a downward direction, and have gradually narrowing channels.

Further, the branch channels 125 are channels that are formed in the nozzle body 100 so as to divide the water fed from the sub-channel 102 and then to provide the divided water to the opposite lower sides of the nozzle part 110, and are formed in a "Y" shape in which predetermined portions thereof are curved below the circular channel 115. The pressurizing channels 127 connect the ends of the branch channels 125 to an end of the linear channel 105 connected to the lower portion of the nozzle part 110, and pressurize the water flowing through the linear channel 105 on the opposite sides of the linear channel 105 just before the water flows into the circular channel 115, thereby allowing the water to flow into the circular channel 115 in the state in which the water is pressurized toward the center of the circular channel 115.

In other words, a cross section of the water flow is easily spread from the circular channel 115 to the expansion opening 117 according to the pressure of the water flowing through the pressurizing channels 127.

Further, the end of each pressurizing channel 127 has an inclined face 128, which is inclined in a flow direction of the water flowing through the nozzle part 110. Thereby, a speed of the water flow flowing to the circular channel 115 is not reduced by the water flows of the pressuring channels 127 provided on the opposite sides of the circular channel 115, and thus the water flows fed from the pressuring channels 127 can be naturally joined to the water flow flowing to the circular channel 115. Thus, a vortex of the water flow flowing to the circular channel 115 is prevented, and the water flow entering the circular channel 115 is easily spread while generating weak turbulence at the boundary between the expansion opening 117 and the circular channel 115.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A bidet having a variable nozzle comprising:

a linear channel connected to a main channel through which water is fed;

a nozzle part connected to the linear channel and ejecting the water in an arcuate shape towards an area of a human body to be washed; and a variable channel connected to opposite sides of the nozzle part and feeding the water to the nozzle part while the water to be ejected is pressurized symmetrically on the opposite sides of the nozzle part, wherein the nozzle part includes an expansion opening formed so as to intersect with a flow direction of the water introduced from the variable channel, wherein the variable channel includes:

branch channels connected to the main channel for feeding the water, dividing and feeding the water to opposite lower sides of the nozzle part, and symmetrically pressurizing the water flowing through the nozzle part on the opposite lower sides of the nozzle part; and pressurizing channels connected to ends of the branch channels in a downward direction, and having gradually narrowing channels.

2. The bidet as set forth in claim 1, wherein the nozzle part includes:

a circular channel ejecting the water and connected with the variable channel; and the expansion opening is formed on diametrically opposite sides of the circular channel at a width less than a diameter of the circular channel, spreading an ejection hole formed at an upper end of the circular channel.

3. The bidet as set forth in claim 2, wherein the expansion opening of the nozzle part has an arcuate shape centering the circular channel.

4. The bidet as set forth in claim 2, wherein the expansion opening includes vertical cutting faces at an upper inner portion thereof, each of which is formed upwards and is spaced apart from the center of the circular channel.

5. The bidet as set forth in claim 1, wherein each of the pressurizing channels has an inclined face at an end thereof which is inclined in a flow direction of the water flowing through the nozzle part.

6. The bidet as set forth in claim 1, wherein the linear channel and the variable channel are connected to the main channel and a sub-channel through which the water is respectively fed, and the nozzle part discharges a linear water flow when the main channel is open while the sub-channel is closed and an arcuate water flow when the main channel and the sub-channel are open.

7. The bidet as set forth in claim 6, wherein the arcuate water flow discharged from the nozzle part when the main channel and the sub-channel are open is varied in a spreading angle depending on a mixing ratio of an amount of the water flowing through the linear channel to that of the water flowing through the variable channel.

* * * * *